US008602620B2

(12) United States Patent
Vollmer et al.

(10) Patent No.: US 8,602,620 B2
(45) Date of Patent: Dec. 10, 2013

(54) LIGHTING APPARATUS

(75) Inventors: Ralf Vollmer, Ulm (DE); Thomas Reiners, Bachhagel (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 635 days.

(21) Appl. No.: 12/672,714

(22) PCT Filed: Aug. 8, 2008

(86) PCT No.: PCT/EP2008/006570

§ 371 (c)(1),
(2), (4) Date: Feb. 9, 2010

(87) PCT Pub. No.: WO2009/021694

PCT Pub. Date: Feb. 19, 2009

(65) Prior Publication Data

US 2011/0038172 A1 Feb. 17, 2011

(30) Foreign Application Priority Data

Aug. 10, 2007 (DE) ..... 10 2007 037 822

(51) Int. Cl.
*F21V 11/00* (2006.01)
*F21V 15/01* (2006.01)

(52) U.S. Cl.
USPC ..... 362/546; 362/543; 362/544; 362/545; 362/548; 362/549

(58) Field of Classification Search
USPC ..... 362/459–549
See application file for complete search history.

(56) References Cited

U.S. PATENT DOCUMENTS

| | | | | |
|---|---|---|---|---|
| 4,477,863 | A | 10/1984 | Walz | |
| 5,006,763 | A | 4/1991 | Anderson | |
| 5,124,895 | A | 6/1992 | Segoshi et al. | |
| 5,258,686 | A | 11/1993 | Segoshi et al. | |
| 5,882,108 | A * | 3/1999 | Fraizer | 362/293 |
| 5,895,113 | A * | 4/1999 | Ozaki et al. | 362/546 |
| 6,124,679 | A | 9/2000 | Vrionis | |
| 7,075,118 | B2 | 7/2006 | Seki | |
| 2006/0163601 | A1 * | 7/2006 | Harle et al. | 257/100 |

FOREIGN PATENT DOCUMENTS

| | | | |
|---|---|---|---|
| DE | 8205219 | U1 | 7/1982 |
| DE | 3701789 | A1 | 8/1988 |
| DE | 4032292 | A1 | 5/1991 |
| DE | 19654190 | A1 | 7/1997 |
| DE | 202004003793 | U1 | 6/2004 |
| DE | 10329078 | A1 | 1/2005 |
| DE | 102006001981 | A1 | 8/2007 |
| JP | 2005189471 | A | 7/2005 |
| JP | 2006184347 | A | 7/2006 |
| JP | 2007134067 | A | 5/2007 |

OTHER PUBLICATIONS

English translation of the International Preliminary Report on Patentability of PCT/EP2008/006570.
English abstract for JP 2006184347 A dated Jul. 13, 2006.

(Continued)

*Primary Examiner* — William Carter

(57) ABSTRACT

A lighting apparatus may include an electrically conductive housing, in whose interior at least one light source and at least one electromagnetic radiation-emitting circuit component configured to operate the at least one light source are arranged; and an electrically conductive cover configured to cover the at least one circuit component; wherein the cover and the housing are electrically connected to one another.

15 Claims, 3 Drawing Sheets

(56) References Cited

OTHER PUBLICATIONS

English abstract for JP 2007134067 A dated May 31, 2007.
English-language abstract of DE 202004003793 U1, Jun. 17, 2004.
English-language abstract of DE 10329078 A1, Jan. 20, 2005.
English-language abstract of DE 3701789 A1, Aug. 4, 1988.
English-language abstract of DE 102006001981 A1, Aug. 2, 2007.
International Search Report of PCT/EP/2008/006570 mailed on Dec. 4, 2008.
German Search Report of DE 102007037822.1 mailed on Aug. 28, 2009.

* cited by examiner

LIGHTING APPARATUS

RELATED APPLICATIONS

The present application is a national stage entry according to 35 U.S.C. §371 of PCT application No.: PCT/EP20081006570 filed on Aug. 8, 2008, which claims priority from German application No.: 10 2007 037 822.1 filed on Aug. 10, 2007.

TECHNICAL FIELD

Various embodiments relate to a lighting apparatus with electromagnetic radiation-emitting components, e.g. using light-emitting diodes (LEDs), and to a vehicle lighting system.

BACKGROUND

When using a switched-mode power supply for operating an LED, the switched-mode power supply typically emits a radiofrequency electromagnetic radiation in the region of above 100 kHz and can therefore result in problems associated with EMC in relation to other electronic components. This is a problem in particular in the automotive sector, in which a large number of electronic components are assembled in a very tight space.

In order to reduce the effects of EMC from the switched-mode power supply, in particular in vehicles, switched-mode power supplies are generally operated in a separate, fully shielded housing, in addition to filtering of the outgoing and incoming lines. This is complex, voluminous and heavy.

SUMMARY

Various embodiments provide a possibility of compact, weight-saving and cost-saving EMC shielding of switched-mode power supplies, e.g. for light-emitting diodes e.g. in vehicle construction, specifically for vehicle headlamps.

The lighting apparatus has an at least partially electrically conductive housing, in whose interior at least one light source, in particular an LED, and at least one electromagnetic radiation-emitting circuit component for operating the at least one light source are arranged. Furthermore, the lighting apparatus has an electrically conductive cover for covering at least part of the circuit component, the cover and the housing being electrically connected to one another.

The cover and the, generally grounded, housing therefore form a Faraday cage, which shields electromagnetic radiation. The interior of the Faraday cage forms a shielded accommodating area for accommodating the circuit component. The housing only needs to be electrically conductive insofar as it can form the shielded accommodating area.

Typically, the housing can have an open side, through which light emitted by the at least one light source is emitted towards the outside.

The use of the housing accommodating the light source for accommodating the emitting components as well means that a separate, complete housing for shielding the emitting components is no longer necessary. This results in compact dimensions and a saving in terms of weight and costs.

In addition, the printed circuit board on which the emitting components are mounted also does not need to be configured in a particular manner. It is possible to use a single-sided printed circuit board with a minimum number of layers, which enables, for example, a cost saving in comparison with the use of multi-layered, double-sided printed circuit boards with a grounding plate, which printed circuit boards could possibly be used likewise for shielding purposes.

The lighting apparatus is particularly well suited for shielding components whose electromagnetic radiation has a frequency of approximately 100 kHz or more.

Preferably, the cover includes an optical element for guiding the beam of light emitted by the at least one light source.

Preferably, the optical element includes a reflector.

Then, the reflector preferably has a metal plating, for example on a nonconductive basic shape.

However, it may also be preferable if the reflector is produced from metal, for example using the deep-drawing process.

The reflector is preferably held electrically conductively on the housing, for example without any further fastening means.

The reflector is alternatively preferably connected to the housing by means of an electrically conductive adhesive.

Alternatively or in addition, the reflector is preferably connected to the housing by means of an electrically conductive, mechanical connecting element, for example a metal clip.

It may alternatively be preferable if the optical element includes a lens.

The optical element preferably has a transparent, electrically conductive coating, the coating especially preferably being electrically connected to the housing.

It is particularly preferred if the coating is electrically connected to the housing by means of an electrically conductive adhesive. Alternatively, any other suitable electrically conductive connection can be used, for example a soldered joint.

Alternatively or in addition, it may be preferable if the cover includes a transparent, non-beam-shaping terminating element, in particular an end plate.

In this case it is preferred if the terminating element has a transparent, electrically conductive coating, which is electrically connected to the housing, in particular if the coating is electrically connected to the housing by means of an electrically conductive adhesive.

Preferred is a lighting apparatus in which the housing is produced from metal.

Alternatively, a lighting apparatus can be preferred in which the housing is produced from conductive, in particular metal-plated, plastic.

Particularly preferred is a lighting apparatus in which the housing is in the form of a heat sink, for example by virtue of the provision of cooling ribs or else without cooling ribs.

Furthermore preferred is a lighting apparatus in which the at least one electromagnetic radiation-emitting circuit component is connected to at least one electronic filter element for reducing emission of electromagnetic radiation from electrical feed lines.

Particularly preferred is the use of such a lighting apparatus in a vehicle, for example as a headlamp, indicator, rear light, brake light, sidelight, lower beam, etc.

The at least one LED can be an individual LED or a plurality of LEDs. The plurality of LEDs can be arranged in groups, so-called LED clusters. The LEDs can be monochromatic or heterochromatic. In particular, the LED cluster can have a plurality of heterochromatic LEDs, preferably suitable for a white additive color mixture, for example of the type RGB, RRGB, RGGB etc. The LEDs can emit spectrally pure or mixed light. Other possible LEDs are ones which emit IR or UV light. Other possible LEDs are ones with a wavelengthconverting material, for example phosphorus-based, for example for converting blue light into yellow light.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
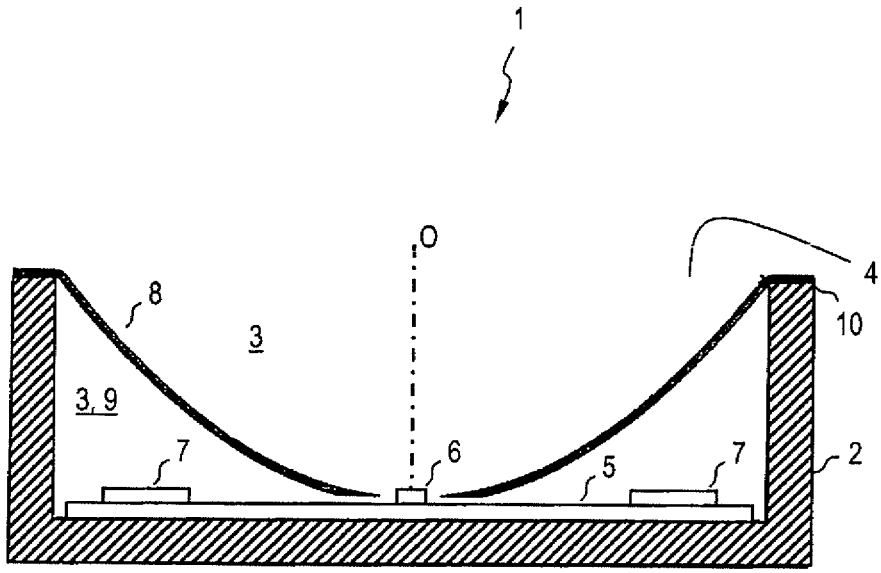
FIG. 1 shows a cross-sectional side view of a lighting apparatus in a first embodiment.

FIG. 1 shows a lighting apparatus 1 with an electrically conductive housing 2, which is rotationally symmetrical about an optical axis O and whose interior 3 has an opening 4 on one side. A non-shielding printed circuit board 5 which is populated on one side is fitted on the base of the interior 3, said printed circuit board 5 being populated on its upper side on one side with an LED 6 and with components 7 of a switched-mode power supply for driving the LED 6. The components 7 are fed by supply lines (not shown), which are passed through the housing 2.

An electrically conductive reflector 8 is positioned onto the edges of the opening 4, said reflector 8 having a central opening (without reference symbol), through which the LED 6 is passed. Light which is emitted by the LED 6 onto the reflector 8 is emitted by means of said reflector 8 through the opening 4 symmetrically with respect to the optical axis O towards the outside. The reflector 8 covers the components 7 of the switched-mode power supply and thereby provides, together with the housing 2, an accommodating area 9 for these components 7. In addition, the reflector 8 and the housing 2 are electrically connected to one another by an electrically conductive adhesive, which is located at the interface 10 between the reflector 8 and the housing 2.

The electrical connection or connection to ground between the reflector 8 and the housing 2 forms a Faraday cage, which prevents the electromagnetic radiation from passing out of the accommodating area 9 or into said accommodating area 9. In this case, the central opening in the reflector 8 through which the LED 6 is passed is harmless for typical frequencies of approximately ≥100 kHz, as are generated by switched-mode power supplies.

In the example illustrated, the reflector 8 consists of metal, possibly with protective layers, and is produced using the deep-drawing process.

Alternatively, the housing is not configured to be rotationally symmetrical, but elongate, in which case the longitudinal axis lies perpendicular to the plane of the drawing in FIG. 1. This case is particularly suitable for an arrangement of a plurality of LEDs next to one another in a row which have a common reflector, for example in order to construct an elongate luminaire, for example a high-level brake lamp.

Alternatively, the reflector can have an in particular large-area metal plating which is connected in a suitable manner to the housing, for example fitted on a plastic basic body. This metal plating can then also be used for light reflection.

It is possible for even the mechanical mounting of the reflector on the housing, i.e. without any adhesive bonding, to be sufficient for the connection to ground of the reflector on the housing. Alternatively or in addition, the connection to ground can be provided, for example, by a mechanical tensioning apparatus made from metal.

Figure 2:
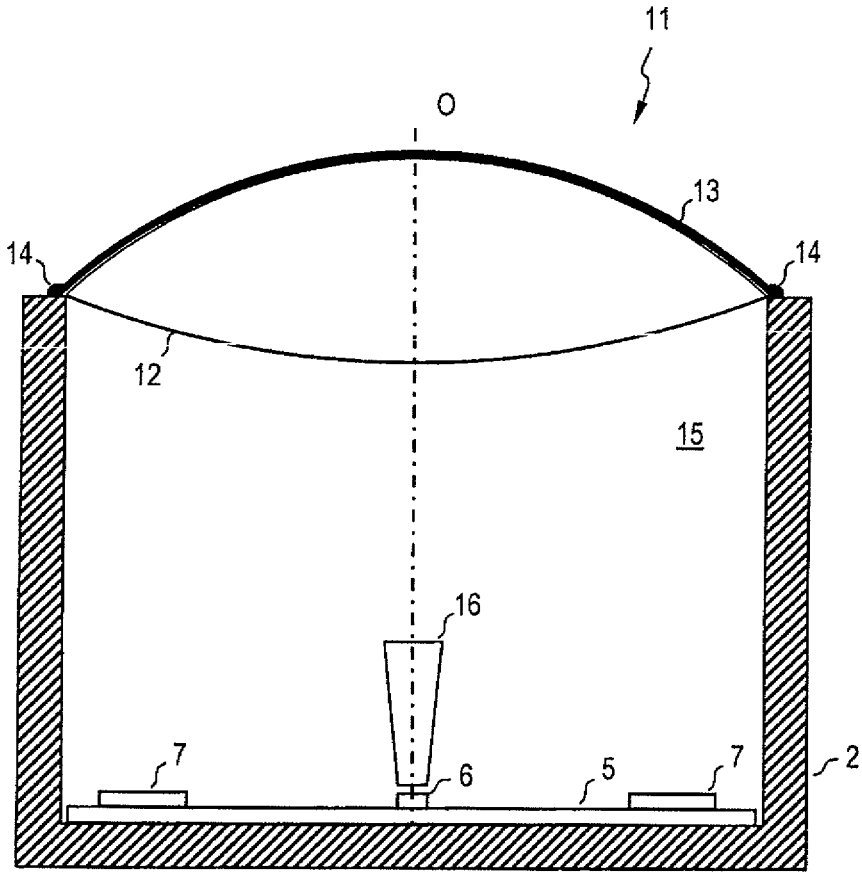
FIG. 2 shows a cross-sectional side view of a lighting apparatus in a second embodiment.

FIG. 2 shows a lighting apparatus 11, which, in contrast to the lighting apparatus shown in FIG. 1, now uses a projection lens 12 as (secondary) optical element instead of a reflector, which projection lens covers the opening 4 and has a transparent, electrically conductive coating 13. The coating 13 is connected to the housing by an electrically conductive adhesive 14, as a result of which the EMC shielding or the formation of the accommodating area 15 now takes place by virtue of the housing 2 and the lens 12 or the coating 13 thereof. The coating 13 can include, for example, InO:Sn, ZnO:AI or carbon nanotubes. Depending on the design, the electrically conductive coating 13 can be applied to the inner side or outer side of the lens 12. In addition, a primary optical element 16 for beam shaping of the light emitted by the LED 6 is arranged between the LED 6 and the lens 12.

In this case, too, the housing does not need to be configured to be rotationally symmetrical, but can also be configured, for example, to be elongate, in particular when using a plurality of LEDs.

Figure 3:
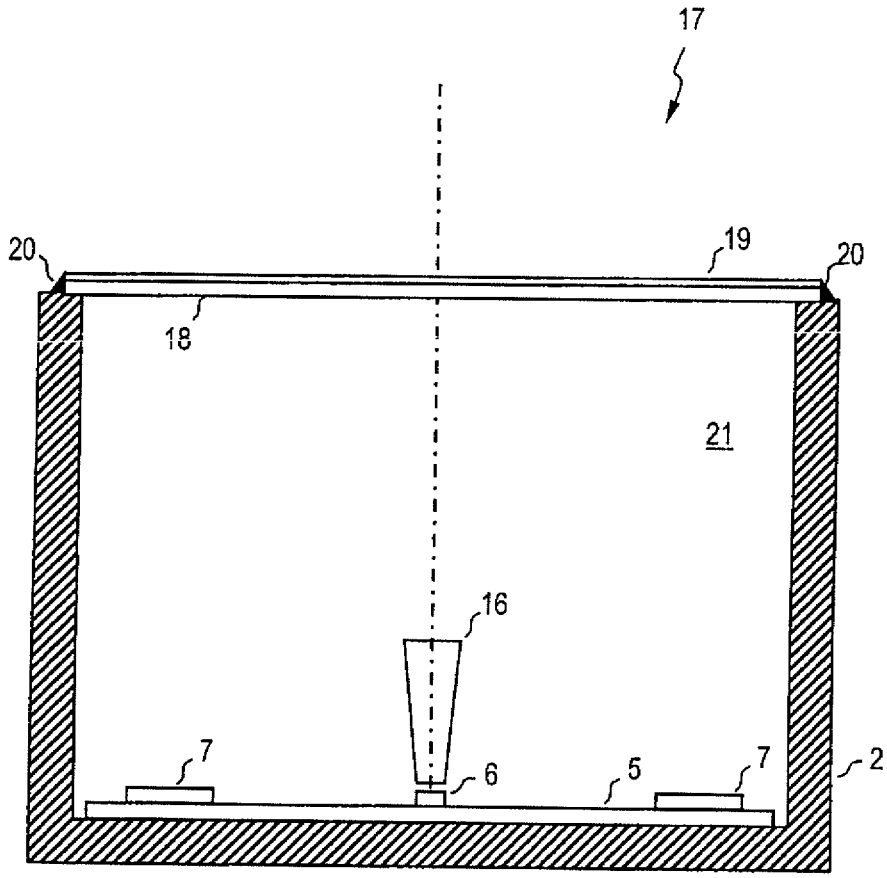
FIG. 3 shows a cross-sectional side view of a lighting apparatus in a third embodiment.

FIG. 3 shows a lighting apparatus 17 in which, in contrast to the embodiment shown in FIG. 2, a transparent end plate 18 without any substantial optical effect is now provided instead of the lens. The end plate 18 also has a transparent, electrically conductive coating 19, which in this example is connected to the housing by an electrically conductive adhesive 20, as a result of which the EMC shielding or formation of the accommodating area 21 now takes place by virtue of the housing 2 and the end plate 18 or the coating 19 thereof. The coating 19 can include, for example, InO:Sn, ZnO:AI or carbon nanotubes. Depending on the design, the electrically conductive coating 19 can be applied to the inner side or outer side of the end plate 18 without any substantial optical effect.

For the EMC-suitable shielding of the electrical feed lines (not depicted) for the lighting apparatus (LED module), electronic filter elements are integrated in the driver electronics 7, said electronic filter elements making shielding of the feed line cables unnecessary. Otherwise, the use of a shielded feed line cable is also possible, which is electrically conductively connected to the corresponding mating plugs at both ends.

The present invention is of course not restricted to the present exemplary embodiments. For example, the shape of the interior may be different, for example not rectangular in cross section but of any desired shape.

The housing can also be in the form of a heat sink and, for this purpose, can have cooling ribs, for example.

The housing can also consist of metal-plated or metal-armored plastic or another suitable electrically conductive material or material composite, for example, instead of solid metal.

The optical element is not restricted to a reflector or a projection lens, but can include any suitable optical elements, for example collimator lenses or lens arrays.

In addition, it is also not necessary for individual LEDs to be used as light source, but it is also possible for LED clusters including a plurality of heterochromatic LEDs to be used, for example, with the colors of said LEDs being additively mixed together.

In general, the invention is not restricted to LEDs, but can also include other suitable light sources which require emitting elements for the driving of said light sources, for example laser diodes.

It is also possible for emitting elements to be accommodated in the accommodating area which are not required for the driving of the LEDs, but for other purposes.

The invention is not restricted to an application in the vehicle construction sector, but can also include all suitable lighting applications.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SYMBOLS

1 Lighting apparatus
2 Housing
3 Interior
4 Opening
5 Printed circuit board
6 LED
7 Components of a switched-mode power supply
8 Reflector
9 Accommodating area
10 Interface
11 Lighting apparatus
12 Projection lens
13 Coating
14 Adhesive
15 Accommodating area
16 Primary optical element
17 Lighting apparatus
18 End plate
19 Coating
20 Adhesive
21 Accommodating area
O Optical axis

The invention claimed is:

1. A lighting apparatus, comprising: an electrically conductive housing, in whose interior at least one light source and at least one electromagnetic radiation-emitting circuit component configured to operate the at least one light source are arranged and wholly encompassed; and an electrically conductive cover configured to immediately and wholly cover the at least one circuit component; wherein the cover and the housing are electrically connected to one another;

wherein the cover comprises an optical element configured to guide the beam of light emitted by the light source;

wherein the optical element comprises a reflector.

2. The lighting apparatus as claimed in claim 1, wherein the at least one electromagnetic radiation-emitting circuit component is configured to emit electromagnetic radiation having a frequency of approximately 100 kHz or more.

3. The lighting apparatus as claimed in claim 1, wherein the reflector has a metal plating.

4. The lighting apparatus as claimed in claim 1, wherein reflector is produced from metal.

5. The lighting apparatus as claimed in claim 1, wherein the reflector is held in an electrically conductive manner on the housing.

6. The lighting apparatus as claimed in claim 1, wherein the reflector is connected to the housing by means of an electrically conductive adhesive.

7. The lighting apparatus as claimed in claim 1, wherein the reflector is connected to the housing by means of an electrically conductive, mechanical connecting element.

8. The lighting apparatus as claimed in claim 1, wherein the housing is produced from metal.

9. The lighting apparatus as claimed in claim 1, wherein the housing is produced from conductive plastic.

10. The lighting apparatus as claimed in claim 1, wherein the housing is in the form of a heat sink.

11. The lighting apparatus as claimed in claim 1, wherein the at least one electromagnetic radiation-emitting circuit component is connected to at least one electronic filter element for reducing emission of electromagnetic radiation from electrical feed lines.

12. The lighting apparatus as claimed in claim 1, wherein the at least one light source has at least one LED.

13. A vehicle lighting system, comprising a lighting apparatus, the lighting apparatus comprising: an electrically conductive housing, in whose interior at least one light source and at least one electromagnetic radiation-emitting circuit component configured to operate the at least one light source are and wholly encompassed arranged; and an electrically conductive cover configured to immediately and wholly cover the at least one circuit component; wherein the cover and the housing are electrically connected to one another;

wherein the cover comprises an optical element configured to guide the beam of light emitted by the light source;

wherein the optical element comprises a reflector.

14. The lighting apparatus as claimed in claim 9, wherein the housing is produced from metal-plated plastic.

15. The lighting apparatus as claimed in claim 1, wherein the at least one electromagnetic radiation-emitting circuit component comprises at least one component of a switched-mode power supply.

* * * * *